US010553055B2

(12) United States Patent
Holighaus

(10) Patent No.: US 10,553,055 B2
(45) Date of Patent: Feb. 4, 2020

(54) LOCKING ARRANGEMENT, IN PARTICULAR DOOR LOCK ARRANGEMENT FOR A SWITCHGEAR CABINET, AND A CORRESPONDING METHOD

(71) Applicant: RITTAL GMBH & CO. KG, Herborn (DE)

(72) Inventor: Heiko Holighaus, Eschenburg (DE)

(73) Assignee: RITTAL GMBH & CO. KG, Herborn (DE)

( * ) Notice: Subject to any disclaimer, the term of this patent is extended or adjusted under 35 U.S.C. 154(b) by 0 days.

(21) Appl. No.: 16/306,360

(22) PCT Filed: Jun. 29, 2017

(86) PCT No.: PCT/DE2017/100547
§ 371 (c)(1),
(2) Date: Nov. 30, 2018

(87) PCT Pub. No.: WO2018/001417
PCT Pub. Date: Jan. 4, 2018

(65) Prior Publication Data

US 2019/0130680 A1 May 2, 2019

(30) Foreign Application Priority Data

Jun. 30, 2016 (DE) ..... 10 2016 112 007

(51) Int. Cl.
*G07C 9/00* (2006.01)

(52) U.S. Cl.
CPC ..... *G07C 9/00182* (2013.01); *G07C 9/00111* (2013.01); *G07C 9/00714* (2013.01)

(58) Field of Classification Search
None
See application file for complete search history.

(56) References Cited

U.S. PATENT DOCUMENTS 6,418,762 B1 7/2002 Münch et al.
6,619,083 B2 9/2003 Hartel et al.
(Continued)

FOREIGN PATENT DOCUMENTS

DE 19801719 A1 7/1999
DE 10049638 C2 2/2003
(Continued)

OTHER PUBLICATIONS

International Search Report (in English and German) and Written Opinion (in German) issued in PCT/DE2017/100547, dated Oct. 11, 2017; ISA/EP.

*Primary Examiner* — Thomas S McCormack
(74) *Attorney, Agent, or Firm* — Harness, Dickey & Pierce, P.L.C.

(57) ABSTRACT

The invention relates to a locking arrangement, in particular a door lock arrangement for a switchgear cabinet, which has a system for verifying a locking authorization, wherein the system has a door lock having an antenna for contactlessly receiving an access authorization signal from a separate transponder, wherein an excitation signal for the transponder is emitted by the antenna only in an active state of the antenna, wherein the locking arrangement has a voltmeter which is used to capture an electrical voltage dropped across the antenna or a voltage change in the passive state of the antenna, wherein the antenna changes from the passive state to the active state if a voltage drop is present across the antenna in the passive state. A corresponding method is also described.

9 Claims, 2 Drawing Sheets

(56) References Cited

U.S. PATENT DOCUMENTS

| | | | |
|---|---|---|---|
| 8,779,891 | B2 | 7/2014 | Rosenthal et al. |
| 2002/0083745 | A1 | 7/2002 | Hartel et al. |
| 2010/0144269 | A1 | 6/2010 | Do et al. |
| 2012/0019357 | A1 | 1/2012 | Rosenthal et al. |
| 2016/0352080 | A1 | 12/2016 | Brueck et al. |

FOREIGN PATENT DOCUMENTS

| | | | |
|---|---|---|---|
| DE | 102009010491 | A1 | 9/2010 |
| DE | 202015101566 | U1 | 5/2015 |
| EP | 0944014 | A2 | 9/1999 |
| EP | 1973055 | A1 | 9/2008 |
| EP | 2169636 | A1 | 3/2010 |

LOCKING ARRANGEMENT, IN PARTICULAR DOOR LOCK ARRANGEMENT FOR A SWITCHGEAR CABINET, AND A CORRESPONDING METHOD

CROSS-REFERENCE TO RELATED APPLICATIONS

This application is a 371 U.S. National Stage of International Application No. PCT/DE2017/100547, filed on Jun. 29, 2017, which claims priority to German Application No. 10 2016 112 007.3, filed on Jun. 30, 2016. The entire disclosures of the above applications are incorporated herein by reference.

BACKGROUND

This section provides background information related to the present disclosure which is not necessarily prior art.

TECHNICAL FIELD

The invention is based on a locking arrangement, in particular a door lock arrangement for a switchgear cabinet, which has a system for verifying a locking authorization, wherein the system has a door lock having an antenna for non-contact reception an access authorization signal from a separate transponder, wherein an excitation signal for the transponder is emitted by the antenna only in an active state of the antenna. Another such locking arrangement is known from DE 20 2015 101 566 U1. DE 10 2009 010 491 A1 describes an access control device, particularly for switchgear cabinet installations.

DISCUSSION

DE 100 49 638 C2 and DE 198 01 719 A1 describe various exemplary embodiments of switchgear cabinet closures which are mounted onto the outer side of a door element of a switchgear cabinet housing and can be coupled with a locking element disposed on the inner side of the switchgear cabinet door, by means of which the switchgear cabinet door, in its locked position, can for example be fastened to a rack. The switchgear cabinet closure can for example be configured as a lever closure having a locking lever which can be moved in the vertical direction and which, through a locking mechanism, can be mechanically coupled to a push-rod closure which is disposed on the inner side of the cabinet door and may comprise a bell crank, such that the push-rod closure is adjusted in the vertical plane by moving the operating lever. To prevent operation of the switchgear cabinet closure by unauthorized individuals, the operating lever is latched in the locked position by means of a door locking arrangement, such that the lever must first be released by the door locking arrangement to operate the cabinet door lock by means of said lever.

DE 20 2015 101566 U1 describes a lock which comprises an antenna in a knob for operating a locking unit of the lock, which antenna can interact with a separate transponder for detecting a locking authorization. The transponder can for example be designed in the form of a key card. For this purpose, the key card may for example comprise an RFID chip. Due to excitation by an incident electromagnetic excitation signal wave, the transponder is configured to send an access authorization signal in response to said excitation signal, which can be a modulated signal of the excitation signal.

The access authorization signal can be received by the antenna of the lock and be forwarded to an evaluation and control unit for actuating the locking element. The control unit can for example be configured to actuate a magnetic switch for operating the locking element conditional on a validity of the access authorization signal detected.

Prior art locking arrangements have the disadvantage that they have a high power consumption, since they permanently or periodically emits excitation signals to detect any transponders that may potentially be near the antenna of the door lock. Permanent emission of excitation signals results in unnecessarily high power consumption, particularly in the case of switchgear cabinets that are not accessed for several years, leaving the door locking arrangement of the switchgear cabinet idle. This makes solutions in which the door locking arrangement is operated by power storage devices such as batteries impracticable.

SUMMARY

This section provides a general summary of the disclosure, and is not a comprehensive disclosure of its full scope or all of its features.

It is therefore the problem of the invention to propose a locking arrangement of the type described at the outset, which has a low power consumption and facilitates that the power consuming components, particularly the system for detecting a locking authorization, can be battery-operated, even over long periods of time.

Accordingly, a locking arrangement comprises a voltmeter which is used to capture an electrical voltage dropped across the antenna or a voltage change in the passive state of the antenna, wherein the antenna changes from the passive state to the active state if a voltage drop is present across the antenna in the passive state.

The antenna of the door lock thus has a dual function. While it is just provided for emitting the excitation signal for the transponder in prior art locking arrangements, it now has the function of a receiver antenna in the passive state, that is, when it does not emit an excitation signal, for initiating the active state of the antenna.

Particularly, the antenna can be designed as a helical antenna in which an electrical voltage drops if the magnetic flux passing through it changes in its near field. This can be triggered if the permeability of the surroundings of the antenna changes, as it happens when an object approaches the antenna which has a permeability that deviates from the permeability of air. For example, the transponder can be designed as a key card, wherein the key card casing has a respective permeability constant that deviates from air. In principle, the material of the transponder alone, e.g. its other antenna, can cause the required change in permeability when it comes closer to the antenna of the door lock, thereby transferring it from its passive state into the active state.

The antenna can comprise a transmitter coil for emitting the excitation signal or such a transmitter coil in which an electric voltage is induced in its passive state as a result of the transponder approaching.

The transponder can comprise a material having a permeability $\mu_r$ (pr designates the permeability number), wherein $\mu_r>1$ and preferably $\mu_r>>1$. The transponder can for example comprise a receiver coil, wherein said receiver coil preferably includes the material having the permeability $\mu_r$, wherein $\mu_r>1$ and preferably $\mu_r>>1$. The material can be a ferromagnet but is not limited to such materials.

The antenna can be communicatively coupled with an electronic control system, which is configured to actuate an oscillation generator for generating the excitation signal if a voltage drop or voltage change is detected at the antenna with the antenna in its passive state.

The transponder can be housed in a key housing, particularly a key card, for example in the form of an RFID chip, wherein said housing is at least partially formed from a material having a permeability $\mu_r$, wherein $\mu_r>1$ and preferably $\mu_r>>1$.

The antenna of the door lock can be connected to an oscillation generator supplied by an electric power source, wherein said oscillation generator is actuated by an electronic control system for generating the excitation frequency, such that the oscillation generator is permanently inactive in the passive state of the antenna.

The electronic control system can be configured to actuate the oscillation generator for generating the excitation frequency in the passive state of the antenna exclusively as a result of a voltage drop captured across the antenna or a voltage change captured at the antenna.

According to another aspect, a method is described for determining a locking authorization for a locking arrangement of the type described above. The method comprises the following steps:

approaching the transponder in which the access authorization data are stored in a memory, to the door lock including the antenna for non-contact reception of an access authorization signal, wherein the approaching causes a temporary change in permeability in the near field of the door lock, thereby inducing an electric voltage in the antenna of the door lock;

capturing a voltage drop or a voltage change across the antenna due to the electric voltage induced; and transferring the door lock from the passive state into the active state as a result of the voltage drop change captured, wherein the antenna emits an excitation signal for the transponder in the active state only.

Furthermore, after transferring the door lock from the passive state into the active state, the door lock can be kept in the active state for a specific time and thus the excitation signal can be emitted, wherein the door lock goes back into the passive state and thus emission of the excitation signal is discontinued if either the time has expired or an access authorization signal has been received from the transponder.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Further details of the invention are explained with reference to the figures below. Wherein.

DETAILED DESCRIPTION

Example embodiments will now be described more fully with reference to the accompanying drawings.

Figure 1:
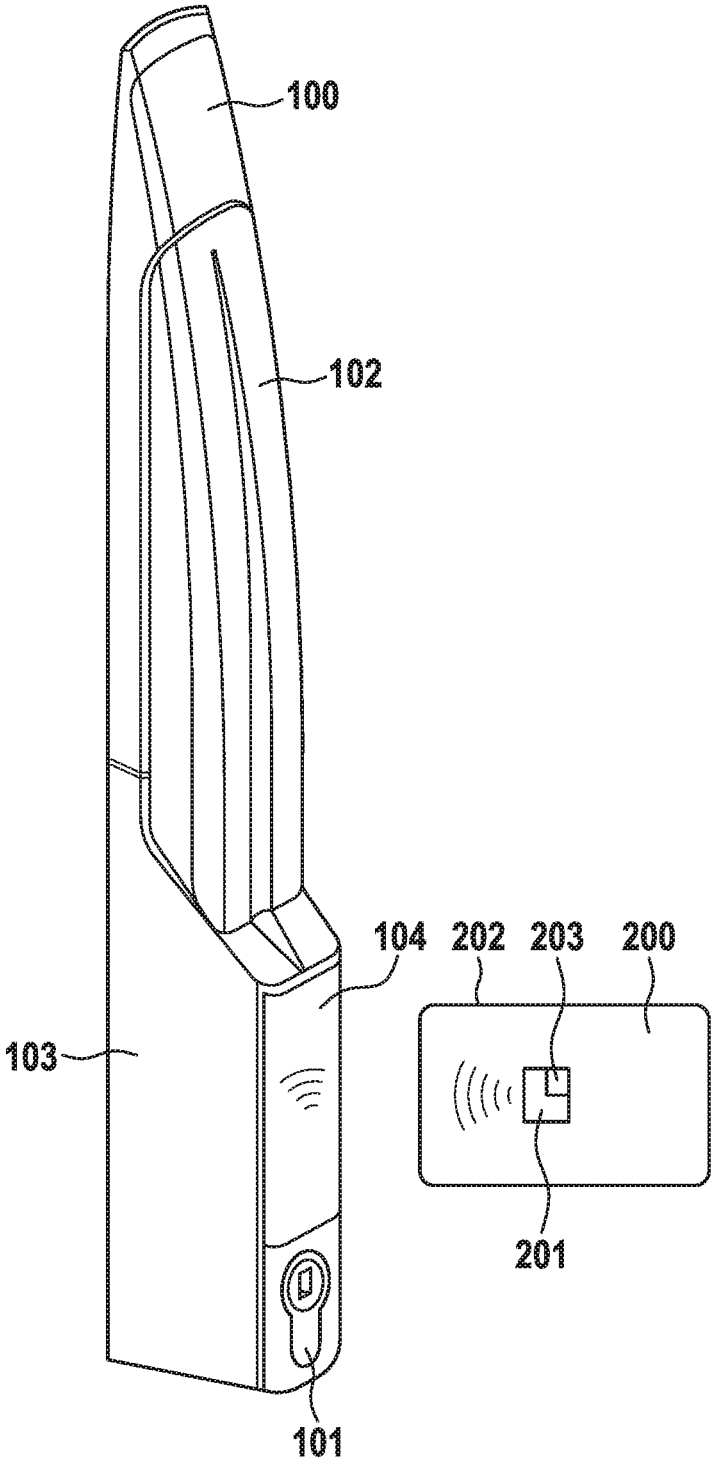
FIG. 1 shows an exemplary embodiment of a locking arrangement.

FIG. 1 shows an exemplary embodiment which is designed as a door locking arrangement for a switchgear cabinet and comprises a system for detecting a locking authorization. Mechanically, the locking arrangement according to FIG. 1 can for example be designed in the form of a bell crank closure for operating a push-rod closure on an inner side of a switchgear cabinet. A respective switchgear cabinet closure is described, for example, in DE 198 01 719 A1. DE 100 49 638 C2 also describes a similar locking device in which the system for detecting a locking authorization is designed as a combination lock, as it is used in prior art to latch the operating lever 102 in the closed position shown in FIG. 1 and to release it only for authorized individuals who have the number combination to be entered in the combination lock.

Instead of the combination lock known from DE 100 49 638 C2, the embodiment according to FIG. 1 is provided with a system for non-contact detection of a locking authorization using transponder technology, as known in principle from DE 20 2015 101 566 U1, for example.

In this embodiment, the front side of the door lock 100 comprises an antenna 104 by means of which an access authorization signal emitted by a key card 200, which comprises a transponder 201, can be received. For this purpose, the door lock 100 emits an excitation signal via the antenna 104, which is received by the transponder 201 and sent back to the antenna 104 in modulated form as an access authorization signal in accordance with an access authorization stored in a memory 203. The antenna 104 is communicatively coupled with an electronic evaluation and control system, which either releases the operating lever 102 in accordance with the access authorization signal or keeps it locked or actuates a respective locking mechanism. The door lock 100 may for example comprise an electromechanically actuated locking bolt or a correspondingly actuated latching pawl for releasing the latching of the lever 102 in the closed position shown.

To reduce power consumption of the locking arrangement according to FIG. 1, the antenna 104 only goes into an active state in which it periodically or continuously emits an excitation signal for the transponder 201 when a change in the magnetic flux in the form of a voltage drop across the antenna 104 is detected in the near field of the antenna 104. This is the case, for example, if the key card 200 approaches the antenna 104 with the transponder 201 and temporarily varies the permeability in the near field of the antenna 104. As soon as this voltage drop has been captured, the antenna 104 transfers into its active state in which it emits an excitation signal for the transponder 201. The result is that the system for detecting a locking authorization described does not consume any power in its standby mode, that is, in the passive state of the antenna 104, and can thus be operated using common power storage devices, such as batteries. A substitute lock 101 is only used for redundancy purposes, particularly for unlatching the lever 102 if the system described above for detecting a locking authorization fails.

Figure 2:
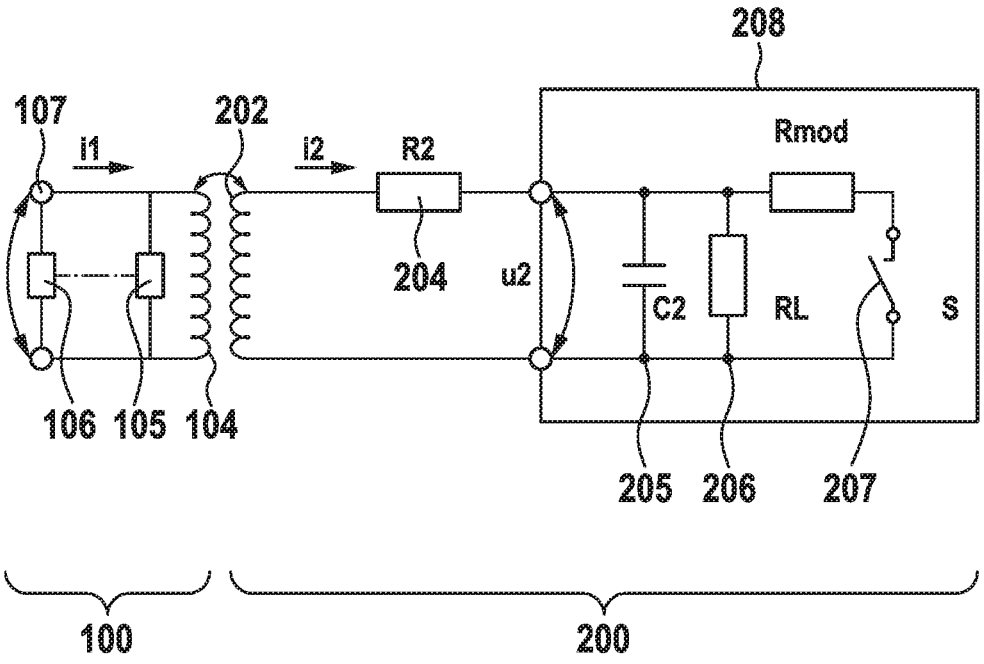
FIG. 2 shows an exemplary embodiment of a system for detecting the locking authorization.

An exemplary wiring diagram for a system for detecting a locking authorization is shown in FIG. 2. The door lock 100 comprises an transmitter coil 104 which forms the antenna of the door lock 100. An oscillation generator 107, which is actuated by an electronic control system 106, acts on the antenna 104 exactly when the latter is in its active state. A voltmeter 105 captures the voltage drop across the antenna 104 due to a change of the magnetic flux in the near field of the antenna 104 when the antenna 104 is in its passive state. The voltmeter 105 transmits a respective voltage signal to the electronic control system 106, which then actuates the oscillation generator to cause the antenna 104 to emit an excitation signal. To prevent faulty switching, the voltage signal or the voltage drop measured by the voltmeter may have to have a specific minimum value. Another option is that the voltage drop must be in a specific expected range, which is the case if the permeability of the key, for example the key card, approaching the antenna is known.

The excitation signal emitted via the antenna 104 can then be received via another antenna 202 of the key 200. The key 200 can for example be designed as a key card which comprises a card chip 208, e.g. an RFID chip.

The resistor 204 illustrates the winding resistance of the other coil 202 of the key 200. The card chip 208 has an input capacity 205, an input resistance 206, and a load modulator 207, which generate an access authorization signal in response to the excitation signal of the door lock 100 received via the other antenna 202 and emit it via the other antenna 202 to the door lock 100, which receives the access authorization signal via the antenna 104. The access authorization signal received is evaluated in a generally known manner (see, for example, DE 20 2015 101 566 U1 or DE 10 2009 010 491 A1), and the locking system of the door lock, for example the locking lever 102 according to FIG. 1, is either released or kept in the locked position if there is no authorization.

Since the system for detecting the locking authorization can remain in standby mode for most of the time, in which it does not consume electric power, wherein the number of locking operations is relatively low, particularly when used for switchgear cabinets, relatively small power storage devices, particularly batteries of common types, are sufficient to supply the system with electric power for a long time, e.g. for several years. The system neither regularly emits excitation signals for detecting RFID cards or transponders, nor does it perform any other kind of active monitoring, as is the case in systems known from prior art.

The invention is therefore based on the idea to use the antenna of the door lock in standby mode as a sensor for activating the emission of an excitation signal via that same antenna. As soon as a key with a transponder, such as a key card, or another object that changes the permeability in the near field of the antenna, e.g. a metal object, particularly a ferromagnetic object, approaches the antenna 104, the temporary variation of permeability in the near field of the antenna 104 induces an electric voltage into the antenna 104. The induced voltage signal is used to activate the system for detecting the locking authorization, therefore to initiate the emission of an excitation signal, such that the key, particularly a key card, can then be queried by the active emission of the excitation signal, exclusively as needed. Battery life can be considerably extended due to complete deactivation in the standby mode.

The features of the invention disclosed in the above description, the drawings and the claims can be relevant both individually and in combination for implementing the invention.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The invention claimed is:

1. A locking arrangement, in particular a door lock arrangement for a switchgear cabinet, which has a system for verifying a locking authorization, wherein the system has a door lock having an antenna for non-contact reception of an access authorization signal from a separate transponder, wherein an excitation signal for the transponder is emitted by the antenna only in an active state of the antenna, wherein the locking arrangement comprises a voltmeter which is used to capture an electrical voltage dropped across the antenna or a voltage change in the passive state of the antenna, wherein the antenna changes from the passive state to the active state if a voltage drop is present across the antenna in the passive state, wherein the antenna of the door lock is connected to an oscillation generator supplied by an electric power source, wherein said oscillation generator is actuated by an electronic control system for generating the excitation frequency, wherein the oscillation generator is permanently inactive in the passive state of the antenna.

2. The locking arrangement according to claim 1, in which the antenna is or comprises a transmitter coil for emitting the excitation signal, in the passive state of which coil an electric voltage is induced in the coil due to an approach of the transponder.

3. The locking arrangement according to claim 1, in which the transponder includes a material with a permeability $\mu_r$, wherein $\mu_r>1$ and preferably $\mu_r>>1$.

4. The locking arrangement according to claim 1, in which the transponder comprises a receiver coil, wherein said receiver coil preferably includes the material having the permeability $\mu_r$, wherein $\mu_r>1$ and preferably $\mu_r>>1$.

5. The locking arrangement according to claim 1, in which the antenna is communicatively coupled with the electronic control system, which is configured to actuate the oscillation generator for generating the excitation signal if a voltage drop or voltage change is detected at the antenna with the antenna in its passive state.

6. The locking arrangement according to claim 1, in which the transponder can be housed in a key housing, particularly a key card, for example in the form of an RFID chip, wherein said housing is at least partially formed from a material having a permeability $\mu_r$, wherein $\mu_r>1$ and preferably $\mu_r>>1$.

7. The locking arrangement according to claim 1, in which the electronic control system is configured to actuate the oscillation generator for generating the excitation frequency in the passive state of the antenna exclusively as a result of a voltage drop captured by the voltmeter across the antenna or a voltage change captured at the antenna.

8. A method for determining a locking authorization for a locking arrangement according to claim 1, comprising the following steps:

approaching the transponder in which the access authorization data are stored in a memory to the door lock including the antenna for non-contact reception of an access authorization signal, wherein the approaching causes a temporary change in permeability in the near field of the door lock thereby inducing an electric voltage in the antenna of the door lock;

capturing a voltage drop or a voltage change across the antenna due to the electric voltage induced; and transferring the door lock from the passive state into the active state as a result of the voltage drop change captured, wherein the antenna sends out an excitation signal for the transponder in the active state only.

9. The method according to claim 8, in which the door lock, after transferring the door lock from the passive state into the active state, is kept in the active state for a specific time and thus the excitation signal is emitted, wherein the door lock goes back into the passive state and thus emission of the excitation signal is discontinued if either the time has expired or an access authorization signal has been received from the transponder.

* * * * *